US006070815A

United States Patent [19]

Miyatake

[11] Patent Number: 6,070,815

[45] Date of Patent: Jun. 6, 2000

[54] GRAIN MILLING MACHINE

[75] Inventor: Yoshikuni Miyatake, Fukuroi, Japan

[73] Assignee: Shizuoka Seiki Co., Ltd., Shizuoka, Japan

[21] Appl. No.: 09/189,889

[22] Filed: Nov. 11, 1998

[30] Foreign Application Priority Data

Nov. 13, 1997 [JP] Japan ..... 9-312040

[51] Int. Cl.[7] ..... B02C 9/00

[52] U.S. Cl. ..... 241/47; 241/65; 241/86; 241/300

[58] Field of Search ..... 241/7, 84, 300, 241/47, 186.5, 65, 299, 86

[56] References Cited

U.S. PATENT DOCUMENTS

| | | | |
|---|---|---|---|
| 3,674,218 | 7/1972 | Globus et al. | 241/46.06 |
| 4,915,307 | 4/1990 | Klimaschka et al. | 241/65 |
| 5,115,984 | 5/1992 | Satake | 241/7 |
| 5,186,968 | 2/1993 | Wellman | 426/483 |
| 5,271,570 | 12/1993 | Satake et al. | 241/7 |

FOREIGN PATENT DOCUMENTS

| | | |
|---|---|---|
| 2-50778 | 11/1990 | Japan . |
| 7-4539 | 1/1995 | Japan . |
| 9-192508 | 7/1997 | Japan . |

*Primary Examiner*—John M. Husar
*Attorney, Agent, or Firm*—Koda & Androlia

[57] ABSTRACT

In a grain milling machine, a milling chamber 25 is defined by a gap between a cylindrical body 24 and a rotating body 23, and grinding plates 27 and 28 are arranged on both facing surfaces of the milling chamber 25. On the surface of at least one of the grinding plates 27 and 28, polyhedral hard diamond abrasive grains are deposited. The grinding plate 27 provided on the side of the cylindrical body 24 is fixed, and the grinding plate 28 provided on the side of the rotating body 24 moves with respect to the grinding plate 27, so that the surfaces of grains fed into the milling chamber 25 are ground by the grinding function applied between the grinding plates 27 and 28. Thus, it is possible to maintain sufficient grinding force and to carry out efficient and high-quality grain milling without the need of any complicated maintenance of the machine.

13 Claims, 5 Drawing Sheets

GRAIN MILLING MACHINE

BACKGROUND OF THE INVENTION

1. Field of the Invention

The present invention relates generally to a grain milling machine for milling grains, such as rice, wheat or barley. More specifically, the invention relates to a vertical grain milling machine for milling grains while the grains are forcibly fed into a lower portion of a milling section to be discharged from an upper portion of the milling section.

2. Related Background Art

Grain milling machines are divided broadly into friction type grain milling machines and grinding type grain milling machines. The friction type grain milling machines are designed to cause grains to pass through a grain milling cylinder at a predetermined pressure to peel rice bran layers from the surfaces of the grains by frictional force or scraping force applied between the grains. Such friction type grain milling machines are widely used for making brown rice into usual milled rice.

The grinding type grain milling machines are designed to mill grains by grinding the surfaces of the grains by means of abrasive grains provided on a grinding roll, which is arranged in a cylindrical punched steel plate having slits to rotate at a high speed, while the grains pass through a gap of about 10 mm between the steel plate and the grinding roll. Such grinding type grain milling machines are used for processing rice for sake brewery, which is obtained by removing rice bran layers and a part of starch layers of brown rice, and for polishing grains having hard rice bran layers, such as heat or barley.

Conventionally, the above described grinding type grain milling machine uses an emery roll 70 shown in FIG. 7 as a grinding roll. On the surface of the emery roll 70, abrasive grains 71 called "emery" (carborundum) are formed. The emery roll 70 is obtained by adding clay, feldspar powders, a binder and water to silicon carbide to form a mixture, sufficiently drying the mixture, and then, heating and sintering the dried mixture at a temperature of about 1400° C. The shape of the emery roll 70 is cylindrical, a screw-shaped, a truncated-cone-shaped or the like, and designed to change the peripheral velocity by changing the diameter thereof.

In the above described conventional grinding type grain milling machine having the emery roll 70, there is a problem in that the depths of the surface flaws of an object to be ground are not constant due to the irregularities of the abrasive grains 71, so that the water absorbing characteristic of milled rice is uneven during rice cooking, thereby making cooked rice grain uneven, and damaging chewing taste.

In addition, since the grinding force deteriorates due to friction force of the emery (abrasive grains 71) and so forth, there are problems in that it is required to frequently exchange the emery roll 70 to make the maintenance of the grain milling machiscreenroublesome and to increase the running costs.

Moreover, some of emery rolls 70 can not obtain sufficient grinding force. Therefore, in case of grain milling which requires to grind a part of starch layers, such as grain milling of rice of old crop and rice for sake brewery, there are problems in that it is required to repeat steps about five to seven times to finish required grain milling, so that the efficiency of grain milling operation is required.

SUMMARY OF THE INVENTION

It is therefore an object of the present invention to eliminate the aforementioned problems and to provide a grinding type grain milling machine which can maintain a sufficient grinding force and carry out efficient and high-quality grain milling and which does not need troublesome maintenance of the machine, such as frequent exchanges of the emery roll 70.

In order to accomplish the aforementioned and other objects, according to one aspect of the present invention, there is provided a grain milling machine having a milling section for milling grains while the grains are forcibly fed into the milling section via one side thereof to be discharged from the other side thereof, the milling section comprising: a cylindrical body having a central axis; a cylindrical rotating body being driven so as to rotate around the central axis of the cylindrical body; a plurality of first grinding plates arranged on an inner peripheral surface of the cylindrical body in circumferential directions thereof; a plurality of second grinding plates arranged on an outer peripheral surface of the rotating body in circumferential directions thereof; and a grinding portion having a plurality of polyhedral hard abrasive grains deposited on surface portions of at least one of the first grinding plates and the second grinding plates.

The hard abrasive grains are preferably diamond abrasive grains. Preferably, the hard abrasive grains have substantially even grain sizes. The grain sizes of the hard abrasive grains are preferably in the range of from 60 meshes to 100 meshes. Preferably, the plurality of hard abrasive grains are discretely distributed. The plurality of hard abrasive grains are preferably distributed at substantially regular intervals. Preferably, each of the hard abrasive grains has a polygonal cross section, each of the hard abrasive grains has a polygonal flat surface, and each of the hard abrasive grains has a straight ridge line. Preferably, the grinding section has a plated layer deposited on a metal base portion of each of at least one of the first grinding plates and the second grinding plates, a lower portion of each of the hard abrasive grains is buried in the plated layer, and an upper portion of each of the hard abrasive grains projects from a surface of the plated layer. The upper portions of the hard abrasive grains preferably project from the surface of the plated layer so as to have substantially the same height. The grain milling machine may be a vertical grain milling machine wherein the milling section is vertically arranged and wherein grains are forcibly fed into a lower portion of the milling section to be discharged from an upper portion of the milling section. The grinding section may be formed on only the first grinding plates.

In the above described grain milling machine, a milling chamber is defined by a gap between a cylindrical body and a rotating body, and grinding plates are arranged on both facing surfaces of the milling chamber. The grinding plate provided on the side of the cylindrical body is fixed, and the grinding plate provided on the side of the rotating body moves with respect to the grinding plate, so that the surfaces of grains fed into the milling chamber are ground by the grinding function applied between the grinding plates. Thus, it is possible to maintain sufficient grinding force and to carry out efficient and high-quality grain milling without the need of any complicated maintenance of the machine. Therefore, it is possible to sufficiently mill grains at one step when the grains pass through the milling chamber.

Since the polyhedral hard abrasive grains having uniform grain sizes are deposited on the surface of the grinding plate, the abrasive grains do not fall and deteriorate due to friction, so that the durability of the grain milling machine can be improved and the grinding force can be improved.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, a preferred embodiment of a grain milling machine according to the present invention will be described.

Figure 1:
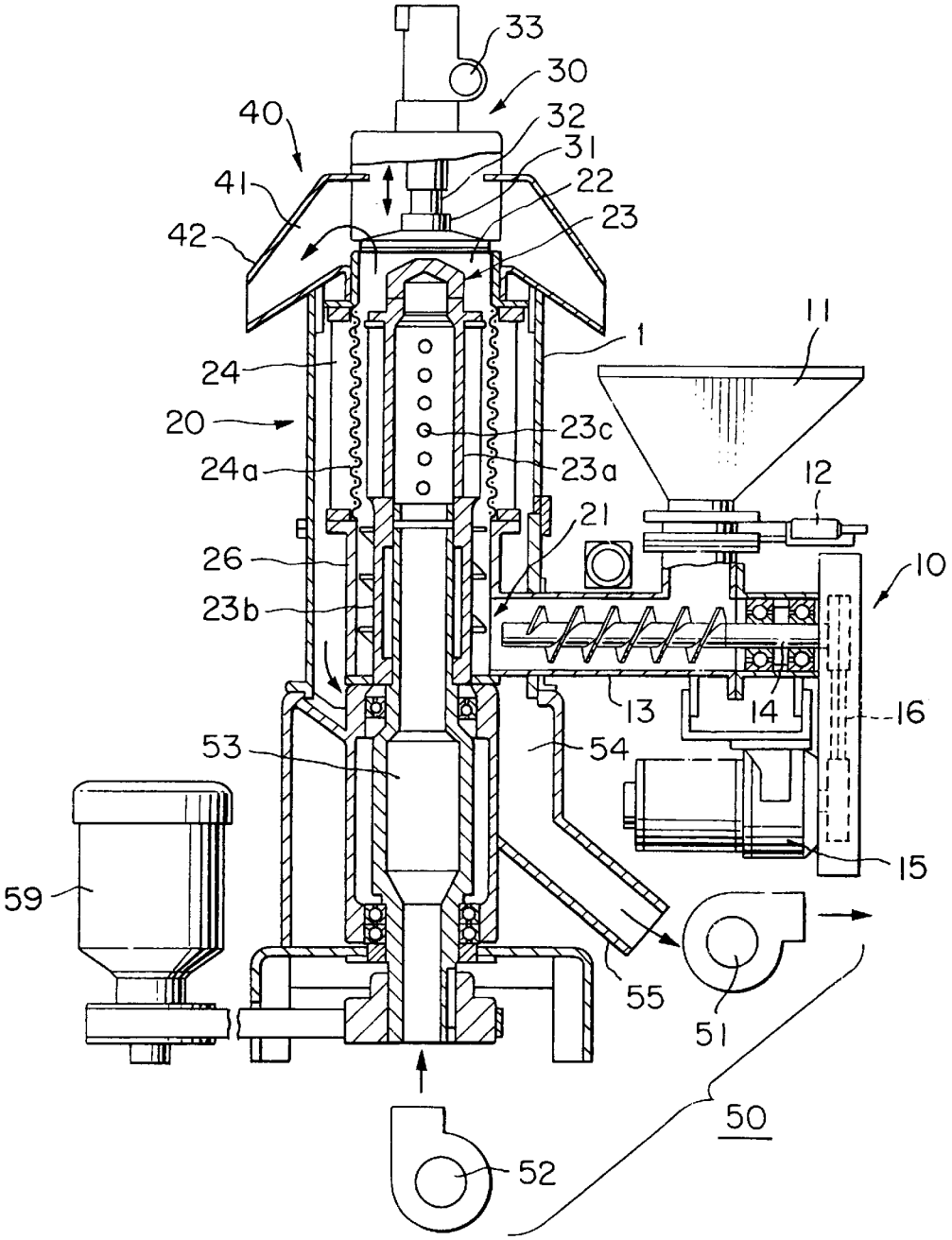
FIG. 1 is a schematic diagram showing the whole construction of a preferred embodiment of a grain milling machine according to the present invention.

FIG. 1 is a schematic diagram showing the whole construction of a preferred embodiment of a grain milling machine according to the present invention. The grain milling machine basically comprises: a base frame 1 and a frame 2 which are associated with each other to form a housing structure; a supply section 10 for supplying grains to be milled; a milling section 20 for milling grains while the grains supplied from the supply section 10 are introduced from the bottom of the milling section 20 to be discharged from the top thereof; a resistance applying section 30 for applying flow resistance to the grains which pass through the milling section 20 to be discharged; a discharge section 40 for discharging the grains milled by the milling section 20; and a draft section 50 for sucking rice bran and so forth separated from the grains in the milling section 20 and for circulating air to cool the grains.

The supply section 10 comprises: a supply passage 13 communicated with an inlet 21; a crossfeed screw 14 rotatably supported in the supply passage 13; a supply motor 15 and a power transmission mechanism 16 for rotating the crossfeed screw 14; and a feed hopper 11 communicated with the supply passage via a flow control plate 12. The inflow of grains thrown in the feed hopper 11 is adjusted by adjusting the opening of the flow control plate 12. The inflow controlled grains flow into the supply passage 13 to be supplied to the inlet 21 by the conveyance function of the crossfeed screw 14.

The resistance applying section 30 comprises: a resistance plate 31 for covering an outlet 22; a resistance body 32 for biasing the resistance plate 31 downwards; and a spring pressure regulating motor 33 for regulating the spring biasing force of the resistance body 31. By regulating the downward spring biasing force of the resistance plate 31 using the spring pressure regulating motor 33, the resistance to the grains leaving the milling section 20 is regulated to adjust the grain milling degree of the grains.

The discharge section 40 has a discharge chamber 41 defined by a discharge chute 42, and discharges the grains leaving the outlet 22.

The draft section 50 comprises a suction fan 51, a forced draft fan 52 and required draft passages. Air force-fed by the forced draft fan 52 passes through a draft passage 53 in a rotating body 23 to cool the grains in the milling section 20, and discharges rice bran, embryos and so forth, which have been separated from the grains, to an exhaust passage 54 comprising the base frame 1 and a suction pipe 55. Suction force is applied to the exhaust passage 54 by the suction fan 51, so that rice bran, embryos and so forth are completely collected in the outside of the machine.

Figure 2:
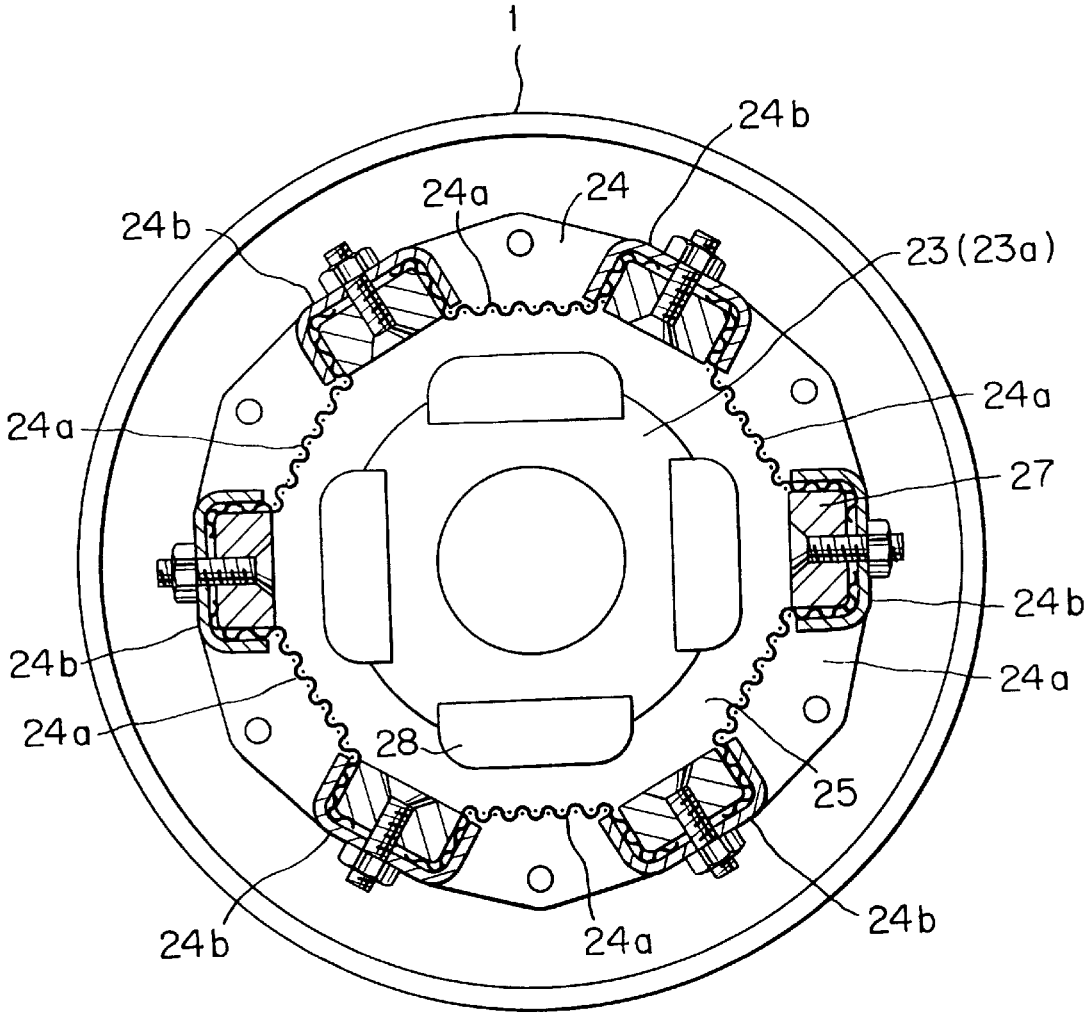
FIG. 2 is a schematic diagram showing a milling section of the grain milling machine of FIG. 1.

Referring to FIGS. 1 and 2, the construction of the milling section 20 serving as a characteristic portion of the present invention will be described below. While a vertical grain milling machine having a vertically arranged milling section 20 is provided in this preferred embodiment, the present invention should not be limited to such a vertical grain milling machine. The milling section 20 comprises a cylindrical body 24, a rotating body 23 rotating around the cylindrical body 24, and a milling chamber 25 defined between the inner peripheral surface of the cylindrical body 24 and the outer peripheral surface of the rotating body 23.

The cylindrical body 24 is arranged in the cylindrical portion of the base frame 1 so as to be coaxial therewith. To the lower portion of the cylindrical body 24, a conveyance drum 26 coaxial with the cylindrical portion of the base frame 1 is connected. That is, the above described milling chamber 25 is formed within the cylindrical body 24 and the conveyance drum 26, and the exhaust passage 54 for collecting rice bran and so forth is formed between the outside of the cylindrical body 24 and the outside of the conveyance drum 26.

As shown in FIG. 2, the cylindrical body 24 comprises: a plurality of frames 24*b* which are arranged in regular intervals in circumferential directions thereof and which face the inner part; a plurality of milling screens provided between the adjacent frames 24*b*; and a plurality of screen fixing grinding plates 27 provided in the frames 24*b*. Each of the screen fixing grinding plates 27, together with the corresponding one of the milling screens 24*a*, is fixed to the corresponding one of the frames 24*b*. Each of the milling screens 24*a* has a plurality of screen holes for discharging rice bran and so forth, which have been peeled off of the grains during grain milling, to the discharge passage 54.

The rotating body 23 extends vertically from the lower end of the frame 2 to be rotatably supported. The lower end of the rotating body 23 is rotated by a motor 59 for grain milling. The rotating body 23 forms a conveyance screw 23*b* in the conveyance drum 26, and a grinding roll 23*a* in the cylindrical body 24. As described above, the interior of the rotating body 23 serves as the draft passage 53, and the grinding roll 23*a* has a plurality of draft holes 23*c*. On the outer peripheral surface of the grinding roll 23*a*, a plurality of vertically elongated grinding roll plates 28 are arranged at regular intervals in circumferential directions.

On the surface of each of the above described screen fixing grinding plates 27 and the grinding roll plates 28, hard abrasive grains having even grain sizes are deposited. The hard abrasive grains may be any abrasive grains having the same super hardness as those of diamond, sapphire and so forth and have grain sizes in the range of from 60 to 100 meshes. The hard abrasive grains are preferably diamond abrasive grains having the highest hardness which can obtain good durability and high cutting force. Furthermore, the optimum grain size is about 80 meshes.

Figure 5:
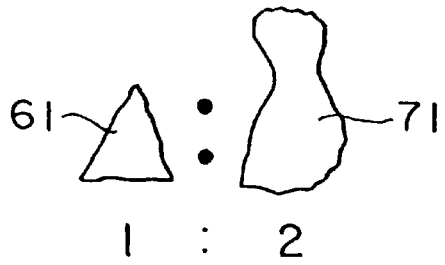
FIG. 5 is a diagram showing the comparison of a diamond abrasive grain provided on the surface of a grinding plate of a grain milling machine according to the present invention with an abrasive grain formed on the surface of a grinding roll for use in a conventional grain milling machine.
Figure 6:
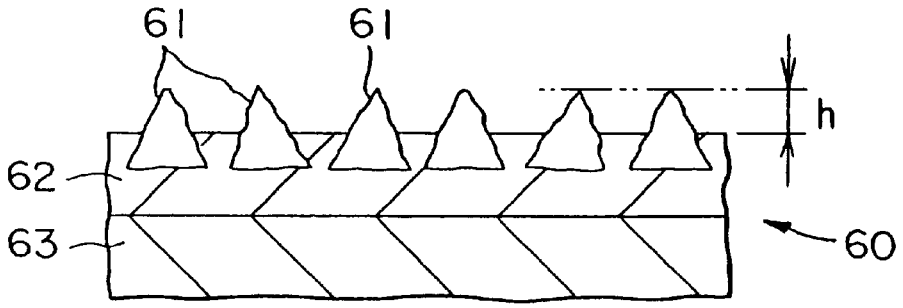
FIG. 6 is a sectional view showing a portion near the surface of a grinding plate of a grain milling machine according to the present invention.

FIG. 6 is a sectional view of a grinding plate surface portion 60 of each of the screen fixing grinding plate 27 and the grinding roll plate 28. Reference number 61 denotes one of diamond abrasive grains provided on the surface of the grinding plate surface portion 60. FIG. 5 shows the comparison of the size of one of the diamond abrasive grains 61 with the size of one of the conventional abrasive grains 71. Each of the diamond abrasive grains 61 has a grain size of about 60 meshes to about 100 meshes, and each of the conventional abrasive grains 71 has a grain size of about 30 meshes to about 40 meshes. The size of each of the diamond abrasive grains 61 is about half of the size of each of the conventional abrasive grains 71. Each of the diamond abrasive grains 61 is polyhedral and has a polygonal cross section. FIGS. 5 and 6 schematically show an example of the shape of each of the diamond abrasive grains 61. In the example shown in FIGS. 5 and 6, each of the diamond abrasive grains 61 has a triangular cross section. The plurality of diamond abrasive grains 61 are discretely distributed at substantially regular intervals and buried in a plated layer 62. The plated layer 62 is provided on a metal base portion 63 of the screen fixing grinding plate 27 or the grinding roll 28.

The top portion of each of the diamond abrasive grains 61 projects from the surface of the plated layer 62. The top portion of each of the diamond abrasive grains 61 is acutely pointed. The bottom portion of each of the diamond abrasive grains 61 is buried in the plated layer 61. In the example shown in FIGS. 5 and 6, the bottom portion of each of the diamond abrasive grains 61 is buried in the plated layer 61 so as to be substantially parallel to the surface of the plated layer 61.

The height h of each of the diamond abrasive grains 61 projecting from the surface of the plated layer 61 is substantially the same as each other.

Figure 8:
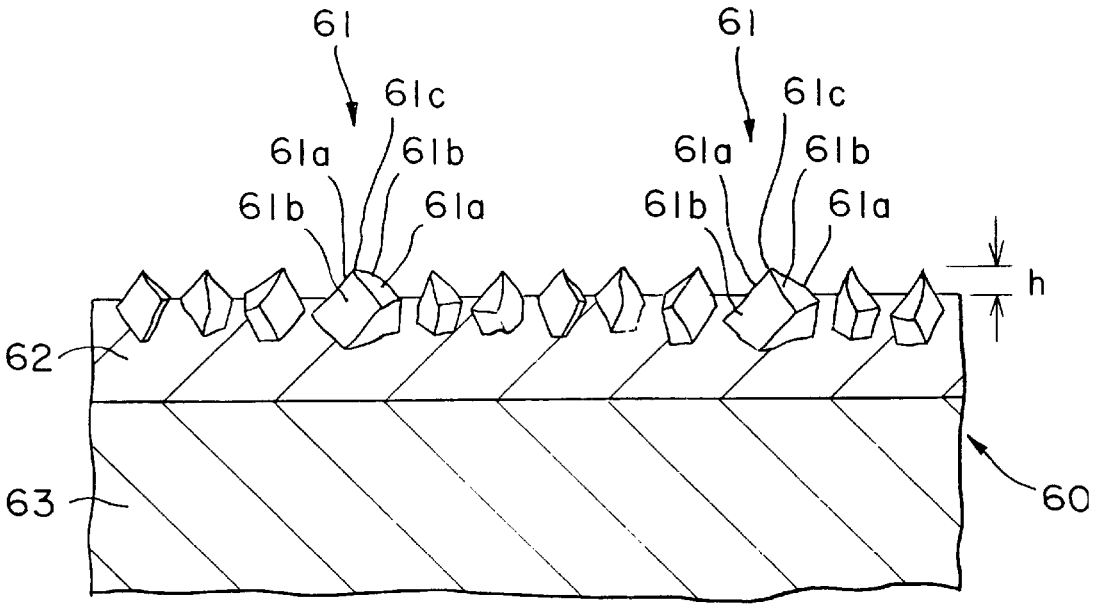
FIG. 8 is a sectional view showing a portion near the actual surface of a grinding plate of a grain milling machine according to the present invention.

Referring to FIG. 8, the diamond abrasive grains 61 provided on the surface of the grinding plate surface portion 60 will be described below. FIG. 6 shows the diamond abrasive grains 61 having ideally the same grain size. On the other hand, FIG. 8 shows an example of actual diamond abrasive grains 61 which can be more easily produced than those shown in FIG. 6.

In FIG. 8, the plated layer 62 is provided on the metal base portion 63 of the grinding roll plate 28, and the plurality of diamond abrasive grains 61 are discretely distributed on the plated layer 62 at substantially regular intervals. The top portion of each of the diamond abrasive grains 61 projects from the surface of the plated layer 62, and the bottom portion of each of the diamond abrasive grains 61 is buried in the plated layer 62. As shown in FIG. 8, each of the diamond abrasive grains 61 is polyhedral and has a straight ridge line portion 61*a*, a flat surface portion 61*b* and an acutely pointed top portion 61*c*.

Figure 7:
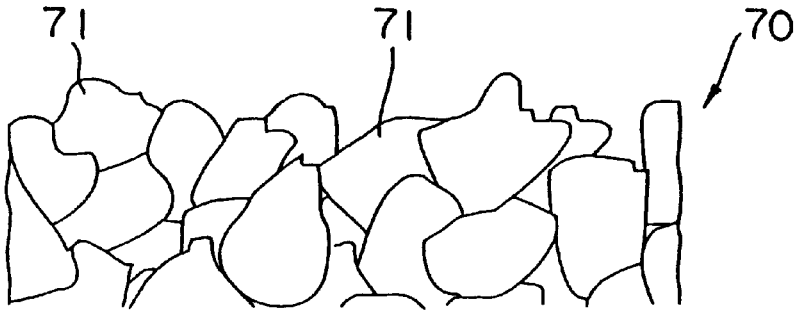
FIG. 7 PRIOR ART
FIG. 7 is a sectional view showing a portion near the surface of a grinding roll for use in a conventional grain milling machine.

Thus, since the plurality of diamond abrasive grains 61 are discretely distributed on the plated layer 62 at substantially regular intervals, rice bran layers produced by grinding grains can be difficult to be received by gaps between the adjacent diamond abrasive grains. In addition, since each of the diamond abrasive grains 61 has the flat surface portion 61*b*, rice bran can be difficult to adhere to the surfaces of the diamond abrasive grains 61. On the other hand, in the conventional case shown in FIG. 7, since the plurality of abrasive grains 71 are provided continuously, not discretely, rice bran is easily received by portions between the adjacent abrasive grains 72, so that there is a problem in that the grinding force deteriorates. In addition, since the surfaces of the abrasive grains 71 are not flat, rice bran is easy to adhere to the surfaces of the abrasive grains 71, so that there is a problem in that the grinding force deteriorates.

In addition, since each of the diamond abrasive grains 61 has the acutely pointed top portion 61c projecting from the surface of the plated layer 61, the surface flaws on the grains can be efficiently ground. Moreover, since each of the diamond abrasive grains 61 has the straight ridge line portion 61*a*, the surface flaws on the grains can be efficiently ground. On the other hand, in the conventional case shown in FIG. 7, since each of the abrasive grains 71 has a smooth top portion and a curved ridge line portion and since the abrasive grains 71 are provided continuously, not discretely, there is a problem in that the surface flaws on the grains can not be efficiently ground.

As described above, since the plurality of diamond abrasive grains 61 having super hardness are discretely distributed on the plated layer 62 at substantially regular intervals, rice bran can be difficult to be received by the gaps between the adjacent diamond abrasive grains 61. In addition, since each of the diamond abrasive grains 61 has the flat surface portion 61*b*, rice bran can be difficult to adhere to the surfaces of the diamond abrasive grains 61. Moreover, since the acute top portion of each of the diamond abrasive grains 61, which has a polyhedral cross section, e.g., a triangular cross section, projects from the surface of the plated layer 61, it is possible to obtain great grinding force. In addition, since the diamond abrasive grains 61 are buried in the plated layer 62 at substantially regular intervals and since the projecting heights h of the diamond abrasive grains 61 are substantially the same, the depths of the surface flaws on the grains can be constant, and uniform boiling rice can be achieved so that the water absorbing characteristic of milled rice is uniform during rice boiling. Moreover, since the top portion of each of the diamond abrasive grains 61 projects from the surface of the plated layer 61 and since the bottom portion of each of the diamond abrasive grains 61 is buried, the diamond abrasive grains 61 are difficult to be taken off of the plated layer 61, so that the high durability of the grinding plate surface portion 60 can be maintained.

Figure 3:
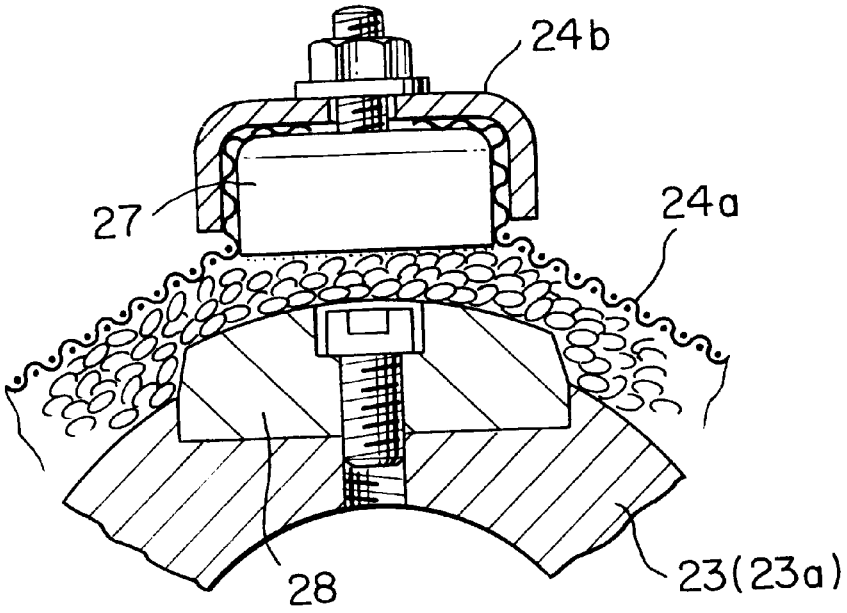
FIG. 3 is a schematic diagram showing the function of the grain milling machine.

Referring to FIGS. 1 and 3, the operation of the milling section 20 of the preferred embodiment of a grain milling machine according to the present invention will be described below.

The grains conveyed from the supply portion 10 are fed into the conveyance drum 26 via the inlet 21. In the conveyance drum 26, the grains turn by 90 degrees to be forcibly fed into the milling chamber 25 by means of the conveyance screw 23*b*. In the milling chamber 25, the internal pressure density is reasonably increased by the self-weight of the grains, and the surfaces of the grains are ground by the grinding function between the grinding roll plate 28 provided on the grinding roll 23*a* and the screen fixing grinding plate 27 provided in the cylindrical body 24 as shown in FIG. 3. Then, while the grains are forcibly conveyed upwards, the grain milling proceeds, and the grains are discharged from the outlet 22 of the milling section 20 to the discharge section 40. In addition, rice bran and so forth produced in the milling chamber 25 are discharged from the milling screen 24*a* to the exhaust passage 54, and conveyed to the outside of the machine by the suction function of the suction fan 51 to be collected in a rice bran box or the like.

The grinding rate in the milling section 20 is adjusted by the operation of the resistance applying section 30 provided on the upper portion of the outlet 22 of the milling section 20, and the grains are ground at up to a milling rate of about 95% even if it is open. Therefore, even in a case where the grains are milled at a milling rate of 95% without being pressed at a first stage and the finish rice milling and the removal of rice bran are carried out by friction at a second stage, the load of friction rice milling is decreased by a high grinding rate, so that the production of broken kernels and the increase in rice milling temperature can be prevented to achieve a high-quality and low-temperature rice milling.

Figure 4:
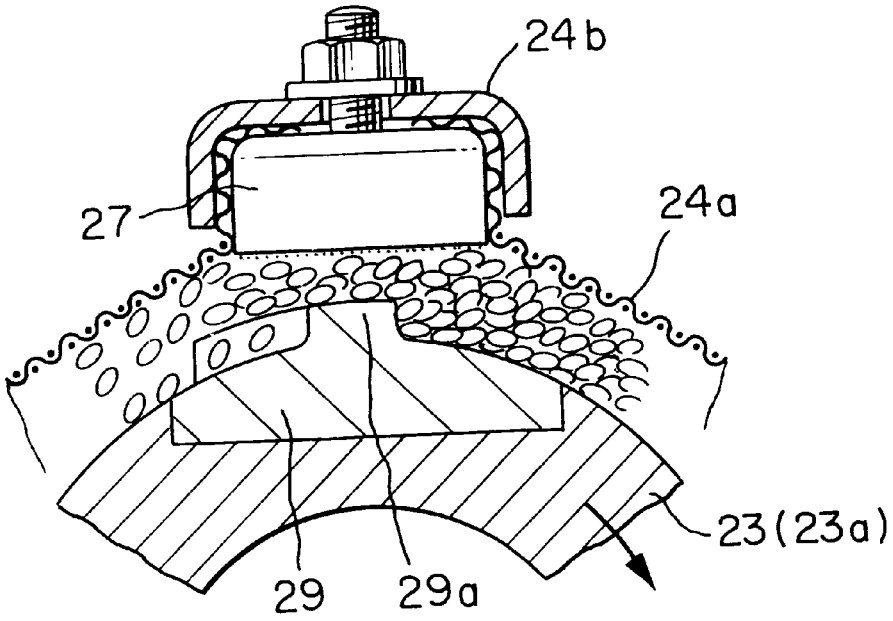
FIG. 4 is a schematic diagram showing another preferred embodiment of the present invention.

FIG. 4 is a schematic diagram showing another preferred embodiment of the present invention.

The same reference numbers are applied to the same portions as those in the above described preferred embodiment, and the duplicate descriptions are omitted. In this embodiment, diamond abrasive grains are deposited only on a screen fixing grinding plate 27, and a friction roll plate 29 having a protrusion 29*a* on the surface thereof is provided on a grinding roll 23*a*. The pressing function of the protrusion 29*a* of the friction roll plate 29 improves the grinding efficiency, so that this embodiment is suitable for grain milling operation for removing embryos.

With this construction, the present invention have the following advantageous effects.

(1) Hard abrasive grains, e.g., diamond abrasive grains 61, which have uniform grain sizes are used to cause the ground depths of grains to be constant, so that the water absorbing characteristic during rice boiling can be stabilized. The optimum super hard abrasive grains are diamond abrasive grains.

(2) The improvement of grinding force allows the grinding of harder starch layers than rice bran layers and the grinding of starch layers of wheat and barley, so that the scope of grain milling, such as the grain milling of low protein rice or the like, can be increased to improve the utilized efficiency of the machine.

(3) By the improvement of grinding force, it is possible to carry out sufficient grinding at one step to improve the operation efficiency and to improve the durability, so that the maintenance of the machine can be easily carried out.

(4) Since the plurality of diamond abrasive grains 61 are discretely distributed on the plated layer 62 at substantially regular intervals, rice bran can be difficult to be received by the gaps between the adjacent diamond abrasive grains 61. In addition, since each of the diamond abrasive grains 61 has the flat surface portion 61*b*, rice bran can be difficult to adhere to the surfaces of the diamond abrasive grains 61. In addition, since each of the abrasive grains 61 has the acute pointed top portion 61*c* projecting from the surface of the plated layer 61, the surface flaws of grains can be efficiently ground. Moreover, since each of the diamond abrasive grains 61 has the straight ridge line portion 61*a*, the surface flaws of grains can be efficiently ground.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A grain milling machine having a milling section for milling grains while the grains are forcibly fed into the milling section via one side thereof to be discharged from the other side thereof, said milling section comprising:

a cylindrical body having a central axis;

a cylindrical rotating body being driven so as to rotate around said central axis of said cylindrical body;

a plurality of first grinding plates arranged on an inner peripheral surface of said cylindrical body in circumferential directions thereof;

a plurality of second grinding plates arranged on an outer peripheral surface of said rotating body in circumferential directions thereof;

a milling chamber defined between said inner peripheral surface of said cylindrical body and said outer peripheral surface of said rotating body; and a grinding portion having a plurality of polyhedral hard abrasive grains deposited on surface portions of at least one of said first grinding plates and said second grinding plates, each of a plurality of polyhedral hard abrasive grains having an acutely pointed top portion.

2. A grain milling machine as set forth in claim 1, wherein said hard abrasive grains are diamond abrasive grains.

3. A grain milling machine as set forth in claim 1, wherein said hard abrasive grains have substantially even grain sizes.

4. A grain milling machine as set forth in claim 1, wherein said grain sizes of said hard abrasive grains are in the range of from 60 meshes to 100 meshes.

5. A grain milling machine as set forth in claim 1, wherein said plurality of hard abrasive grains are discretely distributed.

6. A grain milling machine as set forth in claim 1, wherein said plurality of hard abrasive grains are distributed at substantially regular intervals.

7. A grain milling machine as set forth in claim 1, wherein each of said hard abrasive grains has a polygonal cross section.

8. A grain milling machine as set forth in claim 1, wherein each of said hard abrasive grains has a polygonal flat surface.

9. A grain milling machine as set forth in claim 1, wherein each of said hard abrasive grains has a straight ridge line.

10. A grain milling machine as set forth in claim 1, wherein said grinding section has a plated layer deposited on a metal base portion of each of at least one of said first grinding plates and said second grinding plates, a lower portion of each of said hard abrasive grains is buried in said plated layer, and an upper portion of each of said hard abrasive grains projects from a surface of said plated layer.

11. A grain milling machine as set forth in claim 10, wherein said upper portions of said hard abrasive grains project from the surface of said plated layer so as to have substantially the same height.

12. A grain milling machine as set forth in claim 1, wherein said grain milling machine is a vertical grain milling machine in which said milling section is vertically arranged, and grains are forcibly fed into a lower portion of said milling section to be discharged from an upper portion of said milling section.

13. A grain milling machine as set forth in claim 1, wherein said grinding section is formed on only said first grinding plates.

* * * * *